US006140300A

United States Patent [19]

Sirianni

[11] Patent Number: 6,140,300

[45] Date of Patent: Oct. 31, 2000

[54] LOW-FOAMING CLEANING COMPOSITIONS COMPRISING A HYPOCHLORITE BLEACHING COMPONENT

[75] Inventor: Giuseppe Sirianni, Gimigliano, Italy

[73] Assignee: The Procter & Gamble Company, Cincinnati, Ohio

[21] Appl. No.: 09/202,249

[22] PCT Filed: Jun. 6, 1997

[86] PCT No.: PCT/US97/09939

§ 371 Date: Feb. 24, 1999

§ 102(e) Date: Feb. 24, 1999

[87] PCT Pub. No.: WO97/47713

PCT Pub. Date: Dec. 18, 1997

[30] Foreign Application Priority Data

Jun. 10, 1996 [EP] European Pat. Off. ..... 96870070

[51] Int. Cl.[7] ..... C11D 1/72; C11D 3/395

[52] U.S. Cl. ..... 510/380; 510/406; 510/421; 510/422; 510/430

[58] Field of Search ..... 510/380, 406, 510/421, 422, 423, 424, 425, 430

[56] References Cited

U.S. PATENT DOCUMENTS

| | | | |
|---|---|---|---|
| 4,284,524 | 8/1981 | Gilbert | 510/380 |
| 4,913,833 | 4/1990 | Otten et al. | 510/221 |
| 5,073,286 | 12/1991 | Otten et al. | 510/370 |
| 5,510,047 | 4/1996 | Gabriel et al. | 510/221 |
| 5,705,465 | 1/1998 | Angevaare et al. | 510/380 |

*Primary Examiner*—Caroline D. Liott
*Attorney, Agent, or Firm*—Jason J. Camp

[57] ABSTRACT

A low-foaming cleaning composition comprises a hypochlorite bleaching component, a hypochlorite compatible surfactant, and a capped nonionic ethoxylated surfactant, wherein said nonionic surfactant reduces the foaming due to said hypochlorite compatible surfactants.

9 Claims, No Drawings

LOW-FOAMING CLEANING COMPOSITIONS COMPRISING A HYPOCHLORITE BLEACHING COMPONENT

FIELD OF THE INVENTION

The present invention relates to cleaning compositions, especially to cleaning compositions having easy rinsing properties.

BACKGROUND OF THE INVENTION

Hypochlorite components are known in the art to serve both as a strong oxidiser which assist in the chemical degradation, break-up and removal of stains and soils and also as an effective disinfectant. This dual role of hypochlorite has contributed to the increased use of said component in the formulation of cleaning compositions.

Hypochlorite compatible surfactants, such as amine oxide and/or anionic sulphate surfactants, are also known to contribute to the cleaning performance of cleaning compositions. However, a problem encountered with the use of said surfactant in cleaning compositions is the foaming property of the surfactants which renders the rinsing step more difficult.

One solution would be to incorporate silicone components known as suds suppressor components, and disclosure of such silicone suds suppressing components may be found in EP-A-0,046,342. However, although effective in suppressing the formation of suds, silicone components are incompatible with hypochlorite which thus, results in a decrease of the suds suppressing performance of the silicone component.

Accordingly, the formulator of a cleaning composition is faced with the challenge of formulating a cleaning composition which exhibits low-foaming properties.

The Applicant has now surprisingly found that the use of a capped nonionic ethoxylated surfactant in a cleaning composition comprising a hypochlorite bleaching component and hypochlorite compatible surfactants fulfills such a need. Such nonionic surfactants are known as low-foaming surfactants, but the Applicant has now found that their use further provides a reduction of the foaming due to other hypochlorite compatible surfactants.

SUMMARY OF THE INVENTION

The present invention is a cleaning composition comprising:

a) a hypochlorite bleaching component
b) a hypochlorite compatible surfactant, and
c) a nonionic surfactant having the formula: $R_1(OR_2)_nOR_3$, wherein $R_1$ is a $C_8$–$C_{18}$ linear or branched alkyl or alkenyl group, aryl group, alkaryl group, $R_2$ is a $C_2$–$C_{10}$ linear or branched alkyl group, $R_3$ is a $C_1$–$C_{10}$ alkyl or alkenyl group and n is an integer ranging in the range of from 1 to 20.

In another aspect of the invention, there is provided the use of said nonionic surfactant in a cleaning composition comprising a hypochlorite bleaching component and one or more hypochlorite compatible surfactants, to reduce the foam produced by said hypochlorite compatible surfactants upon use of the cleaning composition.

DETAILED DESCRIPTION OF THE INVENTION

Hypochlorite bleaching component

One essential component of the invention is a hypochlorite bleaching component. A highly preferred hypochlorite bleaching component is an alkali metal hypochlorite. Advantageously, the composition of the invention are stable in presence of this bleaching component. Although alkali metal hypochlorites are preferred, other hypochlorite compounds may also be used herein and can be selected from calcium and magnesium hypochlorite. A preferred alkali metal hypochlorite for use herein is sodium hypochlorite. Compositions according to the present invention comprise said hypochlorite bleaching component such that the content of active chlorine in the compositions is from 0.1% to 5%, preferably from 1% to 2% by weight.

Hypochlorite compatible surfactants

The other essential component for the purpose of the invention is a hypochlorite compatible surfactant. Hypochlorite compatible surfactants are surfactants which contain no functionalities (such as unsaturation, some aromatic structures or hydroxyl groups) susceptible of oxidation by the hypochlorite bleach. Another property of such hypochlorite compatible surfactants is their foaming properties. All hypochlorite compatible surfactants have the common surfactant structure, i.e. they comprise a hydrophobic portion and a hydrophilic portion.

Hypochlorite compatible surfactant for use herein may be of any of a variety of different types including anionics, zwiterrionics, amphoterics.

Suitable anionic surfactants for the purpose of the invention include the alkyl sulphates ($RSO_4$), alkyl ether sulphates ($R(OCH_2CH_2)eSO_4$), alkyl sulphonates ($RSO_3$), alkyl succinates ($ROOCCH_2CH_2COOZ$), alkyl carboxylates ($RCOOM$), alkyl ether carboxylates ($R(OCH_2CH_2)_eCOOM$). In the formulae in brackets, R is a hydrophobic chain ($C_6$–$C_{22}$) alkyl or alkenyl, e is from 0 to 20, Z is M or R', M is H or any counterion such as those known in the art, including Na, K, Li, $NH_4$, amine, and R' is a $C_1$–$C_5$ alkyl group, possibly functionalized with hydroxyl groups, preferably $C_1$–$C_3$, most preferably methyl. Preferred among the above described anionic surfactants are the alkyl sulphate surfactants. Preferred alkyl sulphates for use herein are selected from sodium tallow alkyl sulphate, sodium lauryl sulphate, sodium octyl sulphate and mixtures thereof. Preferred commercially available compounds are Empicol® 0298/F and/or Empimin® LV33 from Albright and Wilson.

Suitable zwiterrionic surfactants include the betaine or sulphobetaine surfactants wherein the molecule contains both basic and acidic groups which form an inner salt giving the molecule both cationic and anionic hydrophilic groups over a broad range of pH values. Some common examples of these detergents are described in U.S. Pat. Nos. 2,082,275, 2,702,279 and 2,255,082, incorporated herein by reference. Preferred betaine or sulphobetaine surfactants have the formula

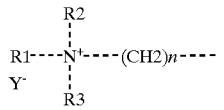

wherein R1 is an alkyl radical containing from about 1 to about 24 carbon atoms, preferably from 8 to 18, and more preferably from 12 to 14, wherein R2 and R3 contain from 1 to 3 carbon atoms, and preferably 1 carbon atom, wherein n is an integer of from 1 to 10, preferably from 1 to 6 and more preferably is 1, Y is selected from the group consisting of carboxyl and sulfonyl radicals and wherein the sum of R1, R2 and R3 radicals is from about 14 to about 24 carbon atoms, or mixtures thereof. Examples of particularly suitable betaine surfactants include C12–$C_{18}$ alkyl dimethyl betaine such as the coconut betaine and C10–C16 alkyl dimethyl betaine such as the lauryl betaine. Coconut betaine and Lauryl betaine are commercially available from Seppic and Albright & Wilson respectively, under the trade name of Amonyl 265® and Empigen BB/L® respectively.

Suitable amphoteric surfactants include the amine oxides corresponding to the formula:

$$R\,R'R''N\rightarrow O$$

wherein R is a primary alkyl group containing 6–24 carbons, preferably 10–18 carbons, and wherein R' and R" are, each, independently, an alkyl group containing 1 to 6 carbon atoms. The arrow in the formula is a conventional representation of a semi-polar bond. The preferred amine oxides are those in which the primary alkyl group has a straight chain in at least most of the molecules, generally at least 70%, preferably at least 90% of the molecules, and the amine oxides which are especially preferred are those in which R contains 10–18 carbons and R' and R" are both methyl. Exemplary of the preferred amine oxides are the N-hexyldimethylamine oxide, N-octyidimethylamine oxide, N-decyidimethylamine oxide, N-dodecyl dimethylamine oxide, N-tetradecyidimethylamine oxide, N-hexadecyl dimethylamine oxide, N-octadecyldimethylamine oxide, N-eicosyidimethylamine oxide, N-docosyldimethylamine oxide, N-tetracosyl dimethylamine oxide, the corresponding amine oxides in which one or both of the methyl groups are replaced with ethyl or 2-hydroxyethyl groups and mixtures thereof. A most preferred amine oxide for use herein is N-decyidimethylamine oxide.

Other suitable amphoteric surfactants for the purpose of the invention are the phosphine or sulfoxide surfactants of formula $$R\,R'R''A\rightarrow O$$

wherein A is phosphorus or sulfur atom, R is a primary alkyl group containing 6–24 carbons, preferably 10–18 carbons, and wherein R' and R" are, each, independently selected from methyl, ethyl and 2-hydroxyethyl. The arrow in the formula is a conventional representation of a semi-polar bond.

The compositions according to the present invention may comprise any of the above surfactants alone, or any combination thereof, depending on the end use envisioned.

A preferred combination of surfactants is the combination of a short chain surfactant and a long chain surfactant, said surfactants comprising a hydrophobic portion and a hydrophilic portion, wherein the chain length of the hydrophobic portion of the short chain surfactant is $C_6$ to $C_9$ and the chain length of the hydrophobic portion of the long chain surfactant is $C_{10}$ to $C_{20}$.

Preferred among the above described surfactants are the alkyl sulphate and/or amine oxide surfactants.

Compositions according to the present invention comprise from 0.1% to 20%, preferably from 0.3% to 10%, preferably from 0.5 to 5% by weight of the composition of said hypochlorite compatible surfactants.

Nonionic surfactant

Another essential component for the purpose of the invention is a capped nonionic ethoxylated surfactant of the formula:

$$R_1(OR_2)_nOR_3$$

wherein $R_1$ is a $C_8$–$C_{18}$ linear or branched alkyl or alkenyl group, aryl group, alkaryl group, preferably, $R_1$ is a $C_{10}$–$C_{15}$ alkyl or alkenyl group, more preferably a $C_{10}$–$C_1$ 5 alkyl group;

$R_2$ is a $C_2$–$C_{10}$ linear or branched alkyl group, preferably a $C_4$ group;

$R_3$ is a $C_1$–$C_{10}$ alkyl or alkenyl group, preferably a $C_1$–$C_5$ alkyl group, and n is an integer ranging in the range of from 1 to 20, preferably from 1 to 10, more preferably from 1 to 5; or mixtures thereof.

These surfactants are commercially available from BASF under the trade name Plurafac®, from HOECHST under the trade name Genapol® or from ICI under the trade name Symperonic®. Preferred capped nonionic ethoxylated surfactant of the above formula are those commercially available under the tradename Genapol® L 2.5 NR from Hoechst, and Symperonic® LF/CS 1100 from ICI.

Compositions according to the present invention comprise from 0.01% to 25%, preferably from 0.05% to 10%, more preferably from 0.1% to 2% by weight of the composition of said nonionic surfactants.

The Applicant has now surprisingly found that the present nonionic surfactant performs dual functions when it is incorporated in the composition herein, said functions being not only to have a low foaming property but also to reduce the foaming of the hypochlorite compatible surfactants.

The other advantage of the invention is that such nonionic surfactant is stable in presence of a hypochlorite bleaching component.

Optional components

The compositions according to the present invention may comprise a number of optional ingredients such as fatty acids, polycarboxylate polymeric component, radical scavengers, antimicrobial compounds, builders, chelants, buffers, bactericides, solvents, enzymes, hydrotropes, colorants, bleach activators, soil suspenders, dye transfer agents, brighteners, anti dusting agents, dispersants, dye transfer inhibitors, pigments, perfumes and dyes.

An optional component of the present invention is a fatty acid, or mixtures thereof. Preferably, the fatty acid is an alkali metal salt of a $C_8$–$C_{18}$ fatty acid. Said fatty acids are used as suds suppressors and will advantageously provide a further reduction of the foam which could still be produced from the hypochlorite compatible surfactants. The fatty acids will, thus, increase the collapse rate of the foam generated by the hypochlorite compatible surfactants. As a result, when incorporated in the composition of the invention, a reduction of the generation of foam as well as an increase in the collapse rate is observed. Suitable fatty acids for use herein can be any $C_8$–$C_1$8 fatty acids, preferably fully saturated, preferably a sodium, potassium or lithium salt, more preferably the sodium salt. Suitable fatty acids may be selected from caprylic acid, capric acid, lauric acid, myristic acid, palmitic acid, stearic acid and mixtures of fatty acids suitably hardened, derived from natural sources such as tallow, coconut oil, ground oil and babassu oil. Compositions according to the present invention comprise from 0.1 % to 10%, preferably from 0.1% to 4%, more preferably less than 0.6% by weight of the composition of fatty acids.

A further optional component suitable when thickening of the composition is desirable is a polycarboxylate polymeric component. Preferably, the polymeric component is a cross-linked polyacrylate polymer. Advantageously, the use of said optional component will also provide a bleach malodour reduction within the product, but also on the cleaned surfaces as well as on the contacted rinsed hands. Commercially available polymers of the polyacrylate type include those sold under the trade names Carbopol®, Acrysol® ICS-1, Polygel®, and Sokalan®. When present, the compositions according to the present invention comprise from 0.1% to 4% by weight, preferably 0.4% to 1.5% by weight of the composition of said polycarboxylate component.

An optional requirement of the compositions according to the present invention is that the pH is greater than 10, preferably greater than 11, more preferably greater than 12. This is achieved by the addition of from 0.4% to 2% of a caustic alkali. Suitable caustic alkalis for use herein include sodium and potassium hydroxide. Compositions according to the present invention comprising hypochlorite preferably have a pH greater than 12 for hypochlorite stability.

The compositions according to the present invention are preferably in liquid form and more preferably are aqueous. Preferably, the liquid compositions of the invention comprise from 80% to 95%, more preferably from 85% to 90% by weight of water.

The compositions according to the present invention are prepared by methods well known in the art such as the methods described in GB 1 329 086 with the exception of the polymer that, if used, it is pre-dispersed in an acidic water solution of pH 3 and then neutralised up to pH 7 before starting adding the other components. The compositions according to the present invention can then be prepared by mixing all of the ingredients in a non-metallic apparatus at room temperature or in warm water. If fatty acid is used, it is melted before being added to the mixture. Other optionals such as perfume and the alkali metal hypochlorite are then added whilst stirring. Colourants, if present, are added after all the other ingredients have been mixed.

The compositions of the present invention may be used for a variety of cleaning purposes such as cleaning hard surfaces whereby said compositions thickened nature results in longer adhesion to the surface than non-thickened compositions. By "hard surface" it is meant herein any surface like bathroom, sanitary fittings such as sinks, showers, wash basins and WCs, kitchen, sinks, cooker tops, table tops, refrigerators, walls, windows and the like.

Packaging form of the compositions

The compositions herein may be packaged in a variety of suitable detergent packaging known to those skilled in the art. The liquid compositions herein may desirably be packaged in manually operated spray dispensing containers, which are usually made of synthetic organic polymeric plastic materials. Accordingly, the present invention also encompasses liquid cleaning compositions of the invention packaged in a spray dispenser, preferably in a trigger spray dispenser. Indeed, said spray-type dispensers allow to uniformly apply to a relatively large area of a surface to be cleaned the liquid cleaning compositions suitable for use according to the present invention; thereby contributing to the cleaning properties of said compositions. Such spray-type dispensers are particularly suitable to clean vertical surfaces.

Suitable spray-type dispensers to be used according to the present invention include manually operated foam trigger-type dispensers sold for example by Specialty Packaging Products, Inc. or Continental Sprayers, Inc. These types of dispensers are disclosed, for instance, in U.S. Pat. No. 4,701,311 to Dunnining et al. and U.S. Pat. No. 4,646,973 and U.S. Pat. No. 4,538,745 both to Focarracci. Particularly preferred to be used herein are spray-type dispensers such as T 8500® commercially available from Continental Spray International or T 8100® commercially available from Canyon, Northern Ireland. In such a dispenser the liquid composition is divided in fine liquid droplets resulting in a spray that is directed onto the surface to be treated. Indeed, in such a spray-type dispenser the composition contained in the body of said dispenser is directed through the spray-type dispenser head via energy communicated to a pumping mechanism by the user as said user activates said pumping mechanism. More particularly, in said spray-type dispenser head the composition is forced against an obstacle, e.g. a grid or a cone or the like, thereby providing shocks to help atomise the liquid composition, i.e. to help the formation of liquid droplets.

The present invention further encompasses a method for cleaning a hard surface by applying on said surface an effective amount of a composition of the invention. The said composition may be applied in its neat form or after having been diluted with water. Preferably said composition is diluted up to 200 times its weight of water, preferably into 50 to 150 times its weight of water and more preferably 75 to 95, before it is applied to said surface. When the composition is diluted prior to use (to reach a total active level in the order of 1.2%), the composition will still advantageously provide effective cleaning performance. In the preferred embodiment of the method of the present invention wherein said composition is applied to a hard-surface to be cleaned in its diluted form, it may not be necessary to rinse the surface after the composition has been applied.

Reduction of the foam produced by hypochlorite compatible surfactants

The benefit provided by the present invention is that the foam produced by the hypochlorite compatible surfactants is reduced, i.e. the use of a composition comprising a hypochlorite compatible surfactants and a capped nonionic ethoxylated surfactant as described above exhibits a reduced generation of foam versus the use of the same composition without the capped nonionic ethoxylated surfactant.

Accordingly, the present invention also relates to the use of said nonionic surfactant in a cleaning composition comprising a hypochlorite bleaching component and one or more hypochlorite compatible surfactants, to reduce the foam produced by said hypochlorite compatible surfactants upon use of the cleaning composition.

Test method for the reduction of foam generation evaluation

The reduction of foam may be measured by comparing the foaming height produced by each composition using the following method:

5 ml of test product are applied to one face of a dry sponge, said face being thereafter wetted with 10 ml of water. The wetted sponge is then squeezed ten times over a graduated cylinder. The collected foam is measured. Differences of ±5 mm are not significant.

In the detergent compositions of the invention, the abbreviated component identifications have the following meanings:

C8 AS: Octyl sulphate, available from Albright and Wilson, under the tradename Empimin® LV33

24 AS: Sodium $C_{12}$–$C_{14}$ alkyl sulphate, available from Albright and Wilson, under the tradename Empicol® 0298/F Amine oxide: $C_{12}$–$C_{14}$ amine oxide, commercially available under the tradename Genaminox® LA from Hoechst Polymer: Copolymer of acrylic acid and alkyl ($C_5$–$C_{10}$) acrylate, commercially available under the tradename Carbopol® 1623 from BF Goodrich Fatty acid: $C_8$–$C_1$ 8 fatty acid nonionic: Capped ethoxylated carboxylate of formula C12–$C_{14}(OCH_2CH_2)_xCH_2COOR$, wherein x is an integer ranging from 2 to 4

The invention is illustrated in the following non limiting examples, in which all percentages are on a weight basis unless otherwise stated.

EXAMPLE

The following compositions, according to the invention, were prepared:

| | A | B | C | D | E | F |
|---|---|---|---|---|---|---|
| C8 AS | 2.0 | — | 3.0 | 2.0 | — | 4.0 |
| 24AS | 2.0 | 3.0 | — | 2.0 | 4.0 | — |
| Amine oxide | — | 1.0 | 1.05 | 2.0 | — | — |
| Fatty acid | — | — | 0.5 | 0.5 | — | — |
| nonionic | 0.5 | 1.0 | 0.5 | 1.0 | 0.5 | 0.5 |
| Sodium hypochlorite | 1.5 | 1.0 | 1.5 | 1.5 | 1.0 | 1.0 |
| Caustic | 1.5 | 1.0 | 1.5 | 1.0 | 1.0 | 1.0 |
| Polymer | 1.0 | 1.5 | 1.5 | — | 1.5 | 1.5 |
| Water and minors up to 100 | | | | | | |

What is claimed is:

1. A cleaning composition comprising:

a) a hypochlorite bleaching component in an amount such that the active chlorine content in the composition is from 0.1% to 5% by weight, b) from about 0.1% to about 20% by weight of a combination of hypochlorite compatible surfactants selected from the group consisting of anionic surfactants, zwitterionic surfactants, amphoteric surfactants, and mixtures thereof, wherein said combination comprises at least one short chain surfactant and at least one long chain surfactant, said short chain surfactant and long chain surfactant comprising a hydrophobic portion and a hydrophilic portion, wherein the chain length of the hydrophobic portion of the short chain surfactant is $C_6$ to $C_9$ and the chain length of the hydrophobic portion of the long chain surfactant is $C_{10}$ to $C_{20}$, and c) from about 0.01% to about 25% by weight of a nonionic surfactant having the formula: $R_1(OR_2)_nOR_3$, wherein $R_1$ is a $C_8$–$C_{18}$ linear or branched alkyl or alkenyl group, aryl group, or alkaryl group, $R_2$ is a $C_2$–$C_{10}$ linear or branched alkyl group, $R_3$ is a $C_1$–$C_{10}$ alkyl or alkenyl group and n is an integer ranging from 1 to 20.

2. A cleaning composition according to claim 1, wherein said nonionic surfactant is present in an amount of about 0.05% to about 10% by weight of the composition.

3. A cleaning composition according to claim 1, wherein said hypochlorite compatible surfactant is present in an amount of from about 0.3% to about 10% by weight of the composition.

4. A cleaning composition according to claim 1, wherein said composition further comprises a fatty acid, or mixtures thereof.

5. A cleaning composition according to claim 4, wherein said fatty acid, or mixtures thereof are in an amount of from about 0.1% to about 10% by weight of the composition.

6. A cleaning composition according to claim 5, wherein said fatty acid, or mixtures thereof are in an amount of from about 0.1% to about 4% by weight of the composition.

7. A cleaning composition according to claim 1, wherein said composition is in liquid form.

8. A liquid composition according to claim 7, wherein said composition is packaged in a spray dispenser.

9. A method of reducing the foam produced by hypochlorite compatible surfactants upon use, which comprises the steps of contacting a surface to be cleaned with a nonionic surfactant-containing composition comprising:

a) a hypochlorite bleaching component in an amount such that the active chlorine content in the composition is from 0.1% to 5% by weight, b) from about 0.1% to about 20% by weight of a combination of hypochlorite compatible surfactants selected from the group consisting of anionic surfactants, zwitterionic surfactants, amphoteric surfactants, and mixtures thereof, wherein said combination comprises at least one short chain surfactant and at least one long chain surfactant, said short chain surfactant and long chain surfactant comprising a hydrophobic portion and a hydrophilic portion, wherein the chain length of the hydrophobic portion of the short chain surfactant is $C_6$ to $C_9$ and the chain length of the hydrophobic portion of the long chain surfactant is $C_{10}$ to $C_{20}$, and c) from about 0.01% to about 25% by weight of a nonionic surfactant having the formula: $R_1(OR_2)_nOR_3$, wherein $R_1$ is a $C_8$–$C_{18}$ linear or branched alkyl or alkenyl group, aryl group, or alkaryl group, $R_2$ is a $C_2$–$C_{10}$ linear or branched alkyl group, $R_3$ is a $C_1$–$C_{10}$ alkyl or alkenyl group and n is an integer ranging from 1 to 20.

* * * * *